US008528529B2

(12) United States Patent
Ewen

(10) Patent No.: US 8,528,529 B2
(45) Date of Patent: Sep. 10, 2013

(54) EXHAUST GAS RECIRCULATION COOLER

(75) Inventor: Kenneth Alfred Ewen, Essex (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/616,162

(22) Filed: Sep. 14, 2012

(65) Prior Publication Data

US 2013/0000619 A1 Jan. 3, 2013

Related U.S. Application Data

(62) Division of application No. 12/841,297, filed on Jul. 22, 2010.

(30) Foreign Application Priority Data

Aug. 1, 2009 (GB) ..... 0913479.2

(51) Int. Cl.
*F02B 47/08* (2006.01)
*F02M 25/07* (2006.01)

(52) U.S. Cl.
USPC ..... 123/568.12

(58) Field of Classification Search
USPC ..... 123/568.12; 60/605.2; 165/100, 165/103, 283, 297
See application file for complete search history.

(56) References Cited

U.S. PATENT DOCUMENTS 2,296,999 A * 9/1942 Kottes ..... 165/82
4,134,377 A * 1/1979 Bamsey et al. ..... 123/568.12
4,593,749 A * 6/1986 Schatz ..... 165/283
5,203,311 A * 4/1993 Hitomi et al. ..... 60/605.2
5,615,738 A * 4/1997 Cameron et al. ..... 165/103
5,617,726 A * 4/1997 Sheridan et al. ..... 60/605.2
7,438,062 B2 * 10/2008 Okawa et al. ..... 123/568.12
7,581,533 B1 * 9/2009 Moran ..... 123/568.12
7,836,868 B2 * 11/2010 Gonzalez et al. ..... 123/568.12
8,230,681 B2 * 7/2012 Kobayashi et al. ..... 60/324
2003/0019620 A1 * 1/2003 Pineo et al. ..... 165/297
2004/0107949 A1 * 6/2004 Miyoshi et al. ..... 123/568.12

(Continued)

FOREIGN PATENT DOCUMENTS

DE 102006052972 A1 5/2008
EP 1933023 A1 6/2008

(Continued)

OTHER PUBLICATIONS

GB Search Report dated Nov. 8, 2010 for Application No. GB1012866.8.

(Continued)

*Primary Examiner* — Willis R Wolfe, Jr.
*Assistant Examiner* — Anthony L Bacon
(74) *Attorney, Agent, or Firm* — Julia Voutyras; Brooks Kushman P.C.

(57) ABSTRACT

An exhaust gas recirculation assembly for an engine is disclosed in which an EGR cooler and a bypass passage are combined in a single housing. Two EGR valves are used to control exhaust gas flow through the EGR cooler and the bypass passage respectively. By using two EGR valves, the disclosure obviates bypass baffles or flaps which can suffer from leakage problems. The arrangement of the EGR valves permits the use of un-cooled EGR valves and the EGR valves can be used to control not only the flow of exhaust gas through the EGR cooler or bypass passage, but also the EGR flow for the engine.

6 Claims, 4 Drawing Sheets

(56) References Cited

U.S. PATENT DOCUMENTS

| | | | | |
|---|---|---|---|---|
| 2007/0089412 | A1* | 4/2007 | Sommerhoff | 60/599 |
| 2007/0289581 | A1* | 12/2007 | Nakamura | 123/568.12 |
| 2008/0156302 | A1 | 7/2008 | El Tahry et al. | |
| 2008/0184974 | A1* | 8/2008 | Kobayashi et al. | 123/568.12 |
| 2008/0245348 | A1* | 10/2008 | Hannewald et al. | 123/568.12 |
| 2008/0257316 | A1* | 10/2008 | Modien et al. | 123/568.2 |
| 2009/0056682 | A1* | 3/2009 | Okawa et al. | 123/568.12 |
| 2009/0077968 | A1* | 3/2009 | Sun | 60/605.2 |
| 2009/0101122 | A1* | 4/2009 | Kurtz et al. | 123/568.12 |
| 2009/0260604 | A1* | 10/2009 | Castano Gonzalez et al. | 123/568.12 |
| 2009/0260605 | A1* | 10/2009 | Janssen et al. | 123/568.12 |
| 2009/0308363 | A1* | 12/2009 | Hoffmann | 123/568.12 |
| 2010/0126478 | A1* | 5/2010 | Okawa et al. | 123/568.12 |
| 2010/0199957 | A1* | 8/2010 | Furukawa et al. | 123/568.12 |

FOREIGN PATENT DOCUMENTS

| | | | |
|---|---|---|---|
| EP | 2133546 | A1 | 12/2009 |
| GB | 2062749 | A | 5/1981 |
| JP | 2009068476 | A | 4/2009 |
| WO | 02052142 | A1 | 7/2002 |

OTHER PUBLICATIONS

GB Search Report dated Oct. 22, 2009 for Application No. GB0913479.2.

* cited by examiner

EXHAUST GAS RECIRCULATION COOLER

CROSS-REFERENCE TO RELATED APPLICATIONS

This application is a divisional and claims priority under 35 U.S.C. §120 to U.S. Ser. No. 12/841,297 filed Jul. 22, 2010 which claims foreign priority benefits under 35 U.S.C. §119 (a)-(d) to GB 0913479.2, filed Aug. 1, 2009, which are hereby incorporated by reference in their entirety.

BACKGROUND

1. Technical Field

This disclosure relates to exhaust gas recirculation (EGR) systems and in particular to an EGR assembly combining EGR flow control and EGR cooling.

2. Background Art

EGR systems are used to recirculate part of the exhaust gas produced by an internal combustion engine, of a vehicle for example, to suppress the generation of nitrogen oxides. EGR systems may incorporate an EGR cooler, a bypass of the EGR cooler, and an EGR valve. See for example EP-A-1933023 which describes a water-cooled, in-line EGR cooler comprising a cylindrical shell.

GB 2062749 A describes an EGR cooler which has the form of a U-shaped tube and is adapted to be mounted directly onto an engine intake manifold.

One known type of EGR valve for regulating the flow of recirculated exhaust gas is described in EP 1918 566. This type of valve, often known as a poppet valve, is electrically controllable in accordance with engine operating conditions. The term 'EGR valve' as meant herein is a poppet valve.

FIGS. 1A and 1B illustrate two alternative arrangements of a known EGR circuit.

In FIG. 1A, a portion of the exhaust gas from an internal combustion engine is directed from the exhaust manifold region 1 to the inlet manifold region 2, via an in-line EGR cooler 3. An EGR valve 4 is positioned on the hot side of the cooler and regulates EGR flow. An EGR cooler is provided to cool the hot exhaust gases to reduce NOx formation even further. A butterfly valve 5 deflects EGR gas either through the cooler 3 or around a bypass link 6. A problem with this arrangement is that as the valve 4 is always cooled, it cools the EGR gas flowing through it, even when engine operating conditions dictate that there is no requirement for the EGR gas to be cooled prior to reaching the intake manifold. This problem can be overcome by re-positioning the valve 4 as shown in FIG. 1B.

In FIG. 1B, the EGR valve 4 is located on the cold side of the cooler 3. However, any contaminants settling on the valve mechanism tend not to get burned off and the valve 4 eventually starts to stick. A further drawback with both of the above arrangements is that the butterfly valve 5 tends to leak so that either not all of the EGR gas reaching the intake manifold is cooled or else not all the EGR gas bypasses the cooler. Furthermore, butterfly valves are often operated by a vacuum system which can be prone to external contamination, creating premature wear of the actuation system.

An EGR system which mitigates the above disadvantages would be advantageous.

SUMMARY

An EGR cooler for use in an EGR system of an internal combustion engine is disclosed. The EGR cooler has a housing having an inlet and an outlet, an EGR cooler passage within the housing and coupled to the inlet, a bypass passage within the housing and coupled to the outlet, a first EGR valve disposed in the housing, and a second EGR valve disposed in the housing. The first EGR valve is disposed between the bypass passage and the EGR cooler passage. The first EGR valve prevents flow from the inlet into the bypass passage when closed; the second EGR valve is disposed between the bypass passage and the EGR cooler passage; and the second EGR valve prevents flow between the EGR cooler and the outlet when closed. The bypass passage is connected in parallel to the EGR cooler so as to selectively permit exhaust gas to bypass the EGR cooler passage. The first EGR valve controls the flow of exhaust gas through the bypass passage and the second EGR valve controls the flow of exhaust gas through the EGR cooler passage. At least one cooler element is disposed in the EGR cooler passage. In one embodiment, a first cooler element is disposed in a first leg of the EGR cooler passage, a second cooler element is disposed in a second leg of the EGR cooler passage, an intermediate passage is provided between the first and second legs of the EGR cooler passage, and a third EGR valve couples the bypass passage and the intermediate passage. In another embodiment, a first cooler element is disposed in a first leg of the EGR cooler passage and a second cooler element is disposed in a second leg of the EGR cooler passage. The first and second legs of the EGR passage form a U-shape. The cooler elements may be water cooled and the EGR valves may be poppet valves which may be commanded to an open position, a closed position, or positions in between.

According to the disclosure there is provided an exhaust gas recirculation (EGR) assembly comprising an EGR cooler passage housing an EGR cooler, a bypass passage connected in parallel to the EGR cooler so as to selectively permit exhaust gas to bypass the EGR cooler without cooling, a first EGR valve for controlling the flow of exhaust gas through the bypass passage and a second EGR valve for controlling the flow of exhaust gas through the EGR cooler passage.

An advantages of the disclosure is that the bypass and cooling functions are controlled by EGR valves, therefore, eliminating the leakage problem suffered by butterfly or flap valves.

The first EGR valve may control the flow of gas entering the bypass passage.

Advantageously, the second EGR valve may control the flow of gas exiting the EGR cooler passage.

This has the advantage that the second EGR valve is never exposed to un-cooled exhaust gas.

The assembly may further comprise a housing having an inlet and a outlet, the EGR cooler passage and the bypass passage are formed as an integral part of the housing and the EGR cooler passage and the bypass passage are connected in parallel between the inlet and outlet of the housing.

This has the advantage that the assembly is economical to manufacture.

The EGR cooler passage is a U-shaped EGR cooler passage.

This has the advantage of allowing the use of a longer EGR cooler passage without increasing the length of the EGR assembly.

The exhaust gas may make two passes through the EGR cooler when passing through the EGR cooler passage.

This has the advantage of providing increased cooling effect.

The EGR cooler has two cooler elements and the exhaust gas passes through at least one of the two EGR cooler elements when passing through the EGR cooler passage.

The assembly may further comprise an intermediate bypass passage located between the two EGR cooler elements so as to selectively connect the EGR cooler passage to the bypass passage and a third EGR valve for controlling the flow of exhaust gas through the intermediate bypass passage to the bypass passage.

This has the advantage of improved controllability of cooling effect.

Further advantages of the disclosure are that the EGR valves do not require cooling as they never need to be exposed to hot exhaust gas while they are open and periodic burn-off of contaminants from one of the valves is possible thus ameliorating the sticking problem mentioned above.

DETAILED DESCRIPTION

Figure 1A:
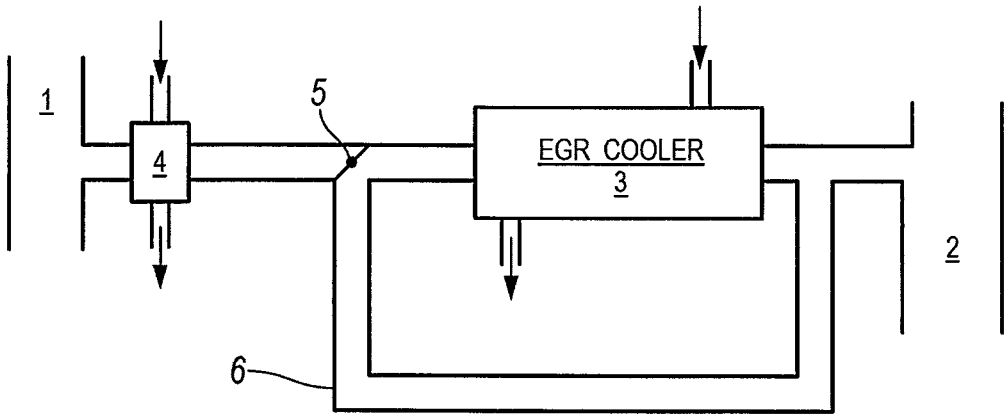
FIG. 1A PRIOR ART
FIGS. 1A and 1B are schematic block diagrams of known prior art EGR systems.

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations.

With reference to FIG. 2, there is shown a first embodiment of an exhaust gas recirculation (EGR) assembly having a housing 7 which has an inlet port 8 for receiving exhaust gas from an engine exhaust and an outlet port 9 for discharging exhaust gas to an engine intake.

The housing 7 defines a U-shaped EGR cooler passage 12 and a bypass passage 11. An EGR cooler 10 is housed in the U-shaped passage 12. The EGR cooler 10 has a series of tubes through which and around which exhaust gas and liquid coolant can flow, respectively.

Adjacent to the inlet and outlet ports 8, 9 are two EGR valves 14, 13. A first ("hot") EGR valve 14 of the two EGR valves 14, 13 controls the flow of EGR gas between the inlet port 8 and the outlet port 9 via the bypass passage 11.

A second ("cold") EGR valve 13 of the two EGR valves 14, 13 controls the flow of EGR gas between the inlet port 8 and the outlet port 9 through the EGR cooler 10 via the U-shaped EGR cooler passage 12.

The bypass passage 11 is connected in parallel to the EGR cooler 10 between the inlet port 8 and the outlet port 9 so as to selectively permit exhaust gas to bypass the EGR cooler 10 without cooling.

The first EGR valve 14 controls the flow of gas entering the bypass passage 11, that is to say, it is located at an upstream end of the bypass passage 11. The second EGR valve 13 controls the flow of gas exiting the U-shaped EGR cooler passage 12. That is to say, the second EGR valve 13 is located at a downstream end of the U-shaped EGR cooler passage 12. This is advantageous in that the second EGR valve 13 is never exposed to very high exhaust gas temperatures. Furthermore, because the first EGR valve 14 is always closed when the exhaust gas is extremely high, this allows the use of un-cooled EGR valves 14, 13.

Some modes of operation of the first embodiment will now be described.

The valves 14, 13 are controlled electrically using known techniques in accordance with an EGR engine management strategy.

When both of the first and second EGR valves 14, 13 are closed (as in FIG. 2A), no exhaust gas flows from an engine exhaust to an engine intake. That is to say, there is no EGR flow.

When the first (hot) EGR valve 14 is open and the second (cold) EGR valve 13 is closed (as in FIG. 2B), exhaust gas is allowed to flow from the engine exhaust to the engine intake but via the bypass passage 11 only, bypassing the EGR cooler 10, (as indicated by the direction of the arrow). This mode of operation is typically employed at engine start-up when the exhaust gas is relatively cool.

Figure 1B:
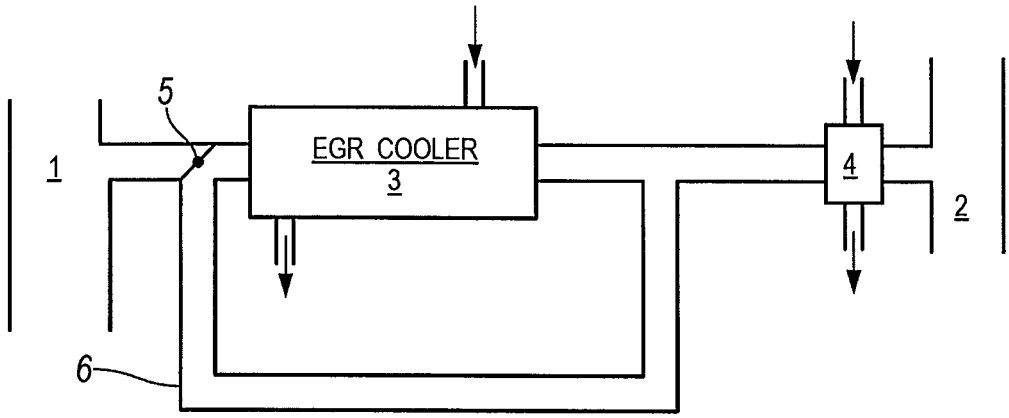
FIG. 1B PRIOR ART

As neither of the first and second EGR valves 14, 13 are cooled, the exhaust gas does not suffer any unnecessary cooling on its way to the engine intake. There is a further advantage over the system shown in FIGS. 1A and 1B in that there is a minimal pressure loss due to the short bypass flow path.

Figure 2A:
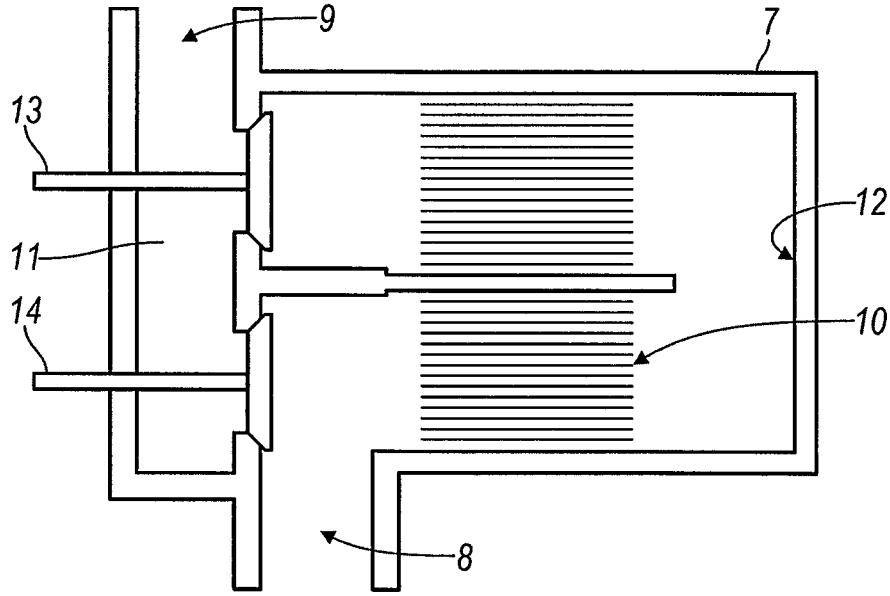
FIGS. 2A to 2E are schematic sectioned views of an EGR assembly in accordance with a first embodiment of the disclosure.
Figure 2B:
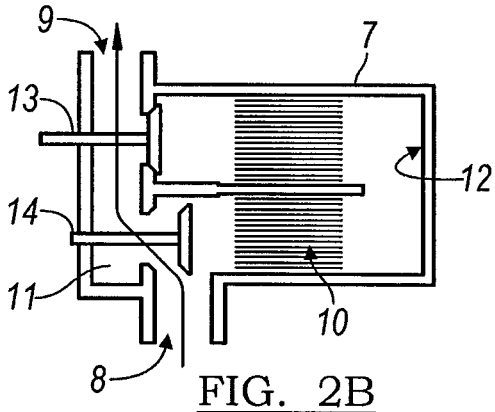
Figure 2C:
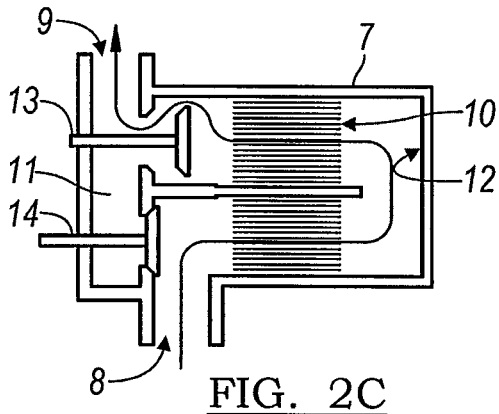

When the first (hot) valve 14 is closed and the second (cold) valve 13 is open, EGR gas is directed through the EGR cooler passage 12 through the EGR cooler 10 and out through the outlet port 9, allowing maximum cooling of exhaust gas (as in FIG. 2C). Note that because of the use of a U-shaped EGR cooler passage 12 the exhaust gas makes two passes through the EGR cooler 10 when passing through the EGR cooler passage 12 thereby maximising the cooling effect on the exhaust gas.

Figure 2D:
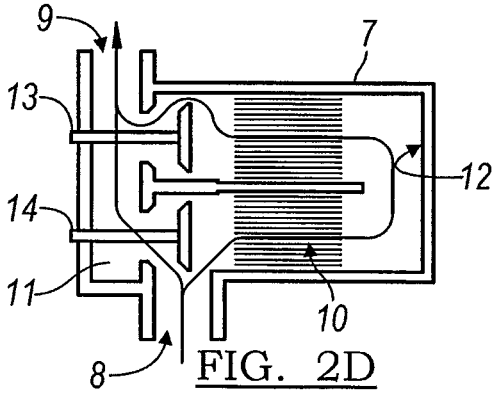
Figure 2E:
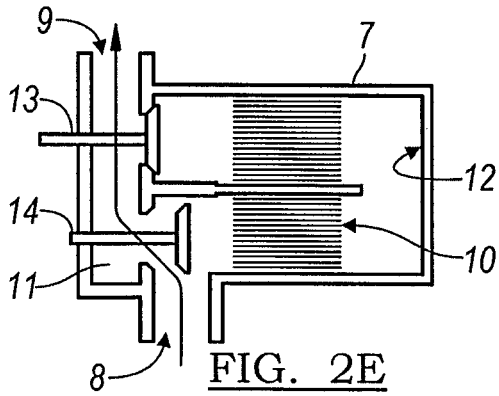

Variable cooling can be achieved by partially opening each of the first and second EGR valves 14,13 so that some exhaust gas flows through the EGR cooler 10 and some flows through the bypass 11 (as in FIG. 2D).

The valves 13, 14 can be regenerated by closing the second (cold) valve 13 and opening the first (hot) valve 12 once the engine has reached normal operating temperature. This procedure can be used to burn off any contaminants which might have accumulated and, if necessary, the engine can be run so as to temporarily increase the exhaust gas temperature thereby speeding up the burn-off. During this process, all exhaust gas flows through the bypass passage 11 (as in FIG. 2E). External test equipment (not shown) can be used to monitor valve operation. If sticking (or slow operation) is suspected, then an engine control module (not shown) can be used to run a valve regeneration cycle for a preset time period whereby engine load is set high so that the EGR gas is hot enough to burn off contaminants.

A second embodiment will now be described with reference to FIGS. 3A and 3B.

The EGR assembly is much as before having a housing 18 with an inlet port 19 and an outlet port 21. The housing 18 defines a U-shaped EGR cooler passage 17 having two limbs in which are mounted an EGR cooler having two cooler elements 26, 27, one located in each of the limbs.

The housing 18 further defines a bypass passage 22 that is arranged in parallel to the U-shaped EGR cooler passage 17 between the inlet and outlet ports 19 and 21 of the housing 18.

The housing further defines an intermediate bypass passage 20 connected between the U-shaped EGR cooler passage 17 and the bypass passage 22 at a position between the two EGR cooler elements 26, 27.

Mounted in the housing 18 are three EGR valves 23, 24, 25. A first, "hot" EGR valve 23 controls the exhaust gas flow between the inlet port 19 through the bypass passage 22 to the outlet port 21. A second, (cold) EGR valve 25 controls the flow of exhaust gas through the U-shaped EGR cooler passage 17 from the inlet port 19 to the outlet port 21. A third, (intermediate) EGR valve 24 controls the flow of exhaust gas through the intermediate bypass passage 20 to the bypass passage 22.

Because the EGR cooler has two separate cooling elements 26, 27, exhaust gas can be diverted through one cooling element 27, both cooling elements 26, 27 or bypass both cooling elements 26, 27 depending on the state of the EGR valves 23, 24, 25. This embodiment therefore, permits a greater degree of control over the cooling of the exhaust gas in addition to bypassing the EGR cooler altogether when no cooling is required.

The third EGR valve 24 controls the flow of gas exiting the intermediate bypass passage 20 that is to say, the third EGR valve 24 is located at a downstream end of the intermediate passage 20 and downstream from the EGR cooler element 27. The second EGR valve 24 is not exposed to very high exhaust gas temperatures and so does not require cooling.

The second EGR valve 25 controls the flow of gas exiting the EGR cooler passage 17 that is to say, the second EGR valve 25 is located at a downstream end of the EGR cooler passage 17 and downstream from the EGR cooler elements 26, 27. The second EGR valve 25 is not exposed to very high exhaust gas temperatures and so does not require cooling.

Furthermore, because the first EGR valve 23 is closed when the exhaust gas temperature is extremely high, this allows the use of an un-cooled EGR valve for the first EGR valve 23.

Figure 3A:
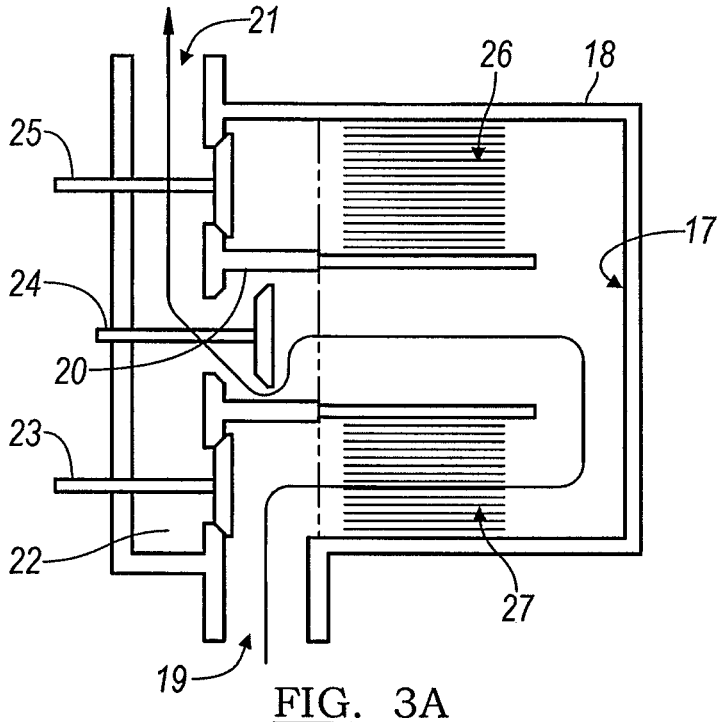
FIGS. 3A to 3B are schematic sectioned views of an EGR assembly in accordance with a second embodiment of the disclosure.

FIG. 3A shows a low level cooling mode of operation where the first and second EGR valves 23, 25 are closed and the third EGR valve 24 is open. This permits EGR gas to flow through just one cooling element 27 of the EGR cooler. This low level cooling can be of use in certain engine operating conditions to achieve optimum combustion without reducing exhaust gas velocity too much in the EGR cooler.

Figure 3B:
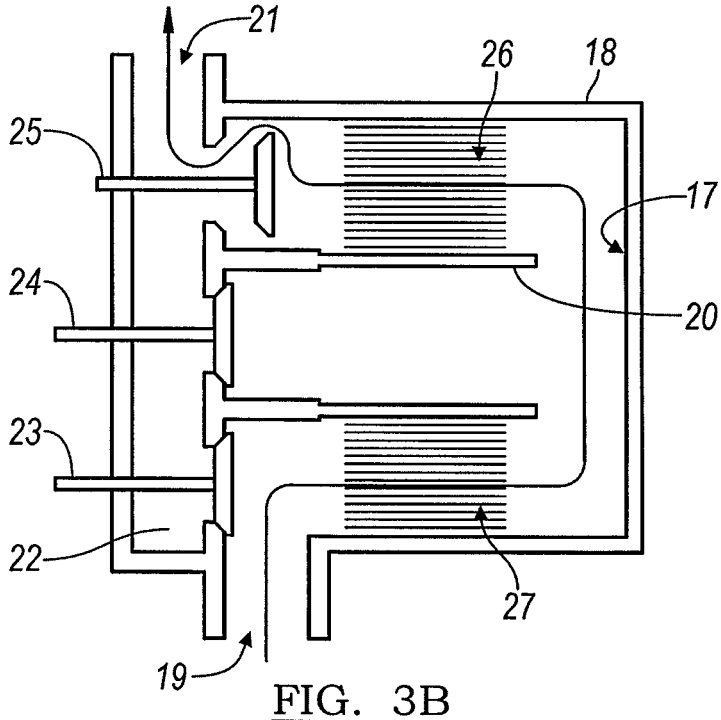

FIG. 3B illustrates a high level cooling mode of operation where the first and third EGR valves 23, 24 are closed and the second EGR valve 25 is open. This allows exhaust gas to flow through both of the cooling elements 26, 27 of the EGR cooler so as to maximise the cooling.

While FIGS. 3A, 3B show an in-line arrangement for the three valves, 23, 24, 25, they may be packaged differently to suit external packaging requirements.

It will be appreciated that by using a U-shaped EGR cooler passage in the above referred to embodiments a very compact EGR assembly can be produced. In addition, by forming the EGR cooler passage and the bypass passage as part of a common housing, the EGR assembly can be manufactured for relatively low cost.

One advantage of the use of a U-shaped EGR cooling passage is that the length of the cooling passage can be longer without increasing the length of the housing. The use of a longer EGR cooling passage provides the opportunity to provide a greater degree of cooling.

A third embodiment will now be described with references to FIGS. 4A to 4E.

With reference to FIG. 4, an EGR assembly comprises a housing 28 which has an inlet port 29 for receiving exhaust gas from an engine exhaust and an outlet port 30 at the opposite end of the cooler 28 for discharging exhaust gas to an engine intake. Inside the housing 28 is a water-cooled, in-line EGR cooler 31 housed in an EGR cooler passage 35 formed as part of the housing 28. The EGR cooler 31 has a series of tubes through which and around which exhaust gas and liquid coolant can flow, respectively.

Integral with the housing 28 and extending away from the outlet port 29 is a bypass passage 32. Mounted in the housing 28 are two EGR valves 33, 34.

A first ("hot") EGR valve 33 of the two EGR valves controls the flow of exhaust gas between the inlet port 29 and the outlet port 30 via the bypass passage 32.

A second ("cold") EGR valve 34 of the two EGR valves controls the flow of exhaust gas between the inlet port 29 and the outlet port 30 via the EGR cooler 31. The second (cold) EGR valve 34 controls the flow of exhaust gas exiting the EGR cooler passage 35. That is to say, it is located downstream from the EGR cooler 31.

Some modes of operation of the third embodiment will now be described. The EGR valves 33, 34 are controlled electrically using known techniques in accordance with an EGR engine management strategy.

When both valve 33, 34 are closed (FIG. 4A), no exhaust gas flows from engine exhaust to engine intake.

When the first (hot) EGR valve 33 is open and the second (cold) EGR valve 34 is closed (FIG. 4B), exhaust gas is allowed to flow from engine exhaust to engine intake but only via the bypass passage 32. The exhaust gas bypasses the EGR cooler 31, as indicated by the direction of the arrow in FIG. 4B. This mode of operation is typically employed at engine start-up when the exhaust gas is relatively cool. As neither of the EGR valves 33, 34 are cooled, the exhaust gas does not suffer any unnecessary cooling on its way to the engine intake.

Figure 4A:
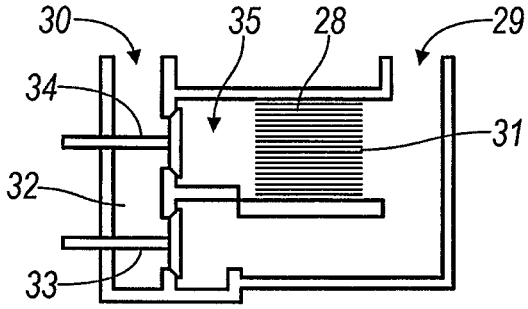
FIGS. 4A to 4E are schematic sectioned views of an EGR assembly in accordance with a third embodiment of the disclosure.
Figure 4B:
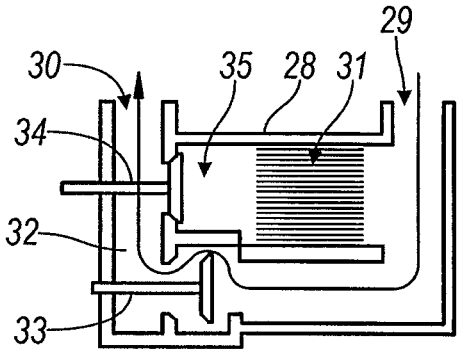
Figure 4C:
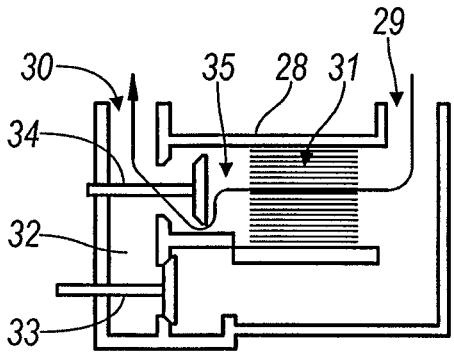

When the first (hot) EGR valve 33 is closed and the second (cold) EGR valve 34 is open, exhaust gas is directed through the EGR cooler 31 producing maximum cooling of exhaust gas (see the arrow in FIG. 4C).

Figure 4D:
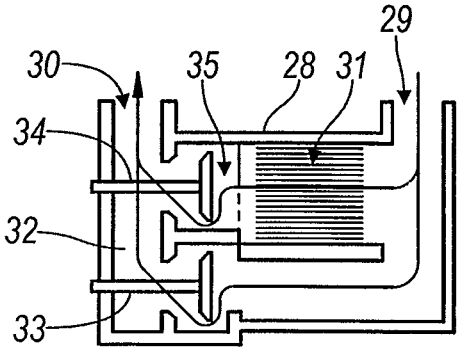

Variable cooling can be achieved, as shown in FIG. 4D, by partially opening each of the two EGR valves 33, 34 so that some EGR gas flows through the cooler 28 and some through the bypass 32 (see the arrows in FIG. 4D).

Figure 4E:
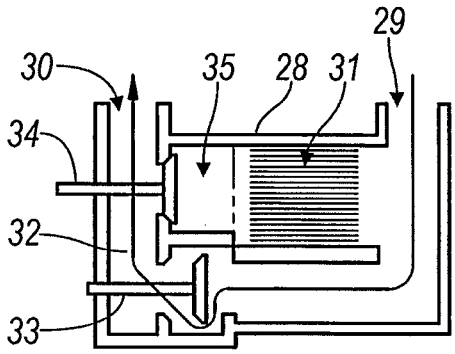

The valves can be regenerated (as shown in FIG. 4E) by closing the second (cold) EGR valve 34 and opening the first (hot) EGR valve 33 once the engine has reached normal operating temperature. This procedure can be used to burn off contaminants which might have accumulated. During this process, all exhaust gas flows through the bypass duct 32. (See the arrow in FIG. 4E). External test equipment (not shown) can be used to monitor valve operation. If sticking or slow operation is suspected then an engine control module (not shown) can be used to run a valve regeneration cycle for a preset time period whereby engine load is set high so that the exhaust gas is hot enough to burn off contaminants.

One advantage of the disclosure is that the valves used to control exhaust gas recirculation flow and those used to control selective cooling of the recirculating exhaust are the same valves. That is to say, the EGR assembly can provide both EGR control and exhaust gas cooling control using the same valves.

A further advantage according to embodiments of the disclosure is that because only EGR valves are used, when these valves are in their respective closed positions there is no leakage past the EGR valves unlike the situation when butterfly or flap valves are used. Therefore when no cooling is required, there is no leakage through the EGR cooler; and when maximum cooling is required, there is no leakage through the bypass passage.

A further advantage of the disclosure is that cooling of the EGR valves is not required because when the exhaust gas temperature is very high the hot EGR valve is closed and the other EGR valve used are located downstream from at least one EGR cooler and so are not exposed to very high exhaust gas temperatures.

While the best mode has been described in detail, those familiar with the art will recognize various alternative designs and embodiments within the scope of the following claims. Where one or more embodiments have been described as providing advantages or being preferred over other embodiments and/or over background art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. The embodiments described as being less desirable relative to other embodiments with respect to one or more characteristics are not outside the scope of the disclosure as claimed.

What is claimed:

1. An exhaust gas recirculation (EGR) assembly, comprising:

a U-shaped EGR cooler passage housing an EGR cooler having two cooler elements, the cooler passage configured such that exhaust gas passes through at least one of the two EGR cooler elements;

a bypass passage connected in parallel to the EGR cooler passage that selectively permits exhaust gas to bypass the EGR cooler;

a first EGR valve located upstream of the bypass passage for controlling the flow of exhaust gas through the bypass passage;

a second EGR valve for controlling flow of exhaust gas through the EGR cooler passage;

an intermediate bypass passage located between the two EGR cooler elements to selectively connect the EGR cooler passage to the bypass passage; and a third EGR valve for controlling the flow of exhaust gas through the intermediate bypass passage to the bypass passage.

2. The EGR assembly of claim 1 wherein each cooler element comprises a water cooled EGR cooler element.

3. The EGR assembly of claim 1 wherein the first, second, and third EGR valves comprise poppet valves.

4. An EGR cooler, comprising:

a housing having an inlet, an outlet, an EGR cooler passage coupled to the inlet, and a bypass passage coupled to the outlet;

first and second EGR valves within the housing between the bypass passage and the EGR cooler passage, the first EGR valve preventing flow from the inlet into the bypass passage when closed and the second EGR valve preventing flow between the EGR cooler and the outlet when closed;

a first cooler element in a first leg of the EGR cooler passage;

a second cooler element in a second leg of the EGR cooler passage;

an intermediate passage between the first and second legs of the EGR cooler passage; and a third EGR valve coupled between the bypass passage and the intermediate passage.

5. The EGR cooler of claim 4, further comprising:

a first cooler element in a first leg of the EGR cooler passage; and a second cooler element in a second leg of the EGR cooler passage wherein the first and second legs of the EGR passage form a U-shape.

6. The EGR cooler of claim 4 wherein the first and second EGR valves comprise poppet valves.

* * * * *